United States Patent [19]

Colvert et al.

[11] 4,033,856

[45] July 5, 1977

[54] FLUIDIZED CATALYTIC CRACKING PROCESS WITH IMPROVED INTERMEDIATE CYCLE GAS OIL STRIPPING

[75] Inventors: James H. Colvert; Frederick C. Jahnke; Dale Williams, all of Houston, Tex.

[73] Assignee: Texaco Inc., New York, N.Y.

[22] Filed: Dec. 22, 1975

[21] Appl. No.: 642,870

[52] U.S. Cl. ..... 208/102; 208/103; 208/164; 208/354

[51] Int. Cl.[2] ..... C10G 7/00; C10G 37/00

[58] Field of Search ..... 208/100, 102, 103, 164, 208/354, 355, 365

[56] References Cited

UNITED STATES PATENTS

| | | | |
|---|---|---|---|
| 2,321,826 | 6/1943 | Kraft et al. | 208/355 |
| 2,327,534 | 8/1943 | Lambert | 208/355 |
| 2,879,224 | 3/1959 | Lawson | 208/100 |
| 2,890,164 | 6/1959 | Woertz | 208/164 |
| 3,751,359 | 8/1973 | Bunn | 208/164 |

*Primary Examiner*—Herbert Levine
*Attorney, Agent, or Firm*—Carl G. Ries; Thomas H. Whaley; Douglas H. May, Jr.

[57] ABSTRACT

The present application discloses a fluidized catalytic cracking process wherein intermediate cycle gas oil is stripped of light cycle gas oil components employing reboiled intermediate cycle gas oil as stripping vapor for improving light cycle gas oil yield, reducing feed preheat requirements, and reducing sour water production from a fluidized catalytic cracking unit.

5 Claims, 1 Drawing Figure

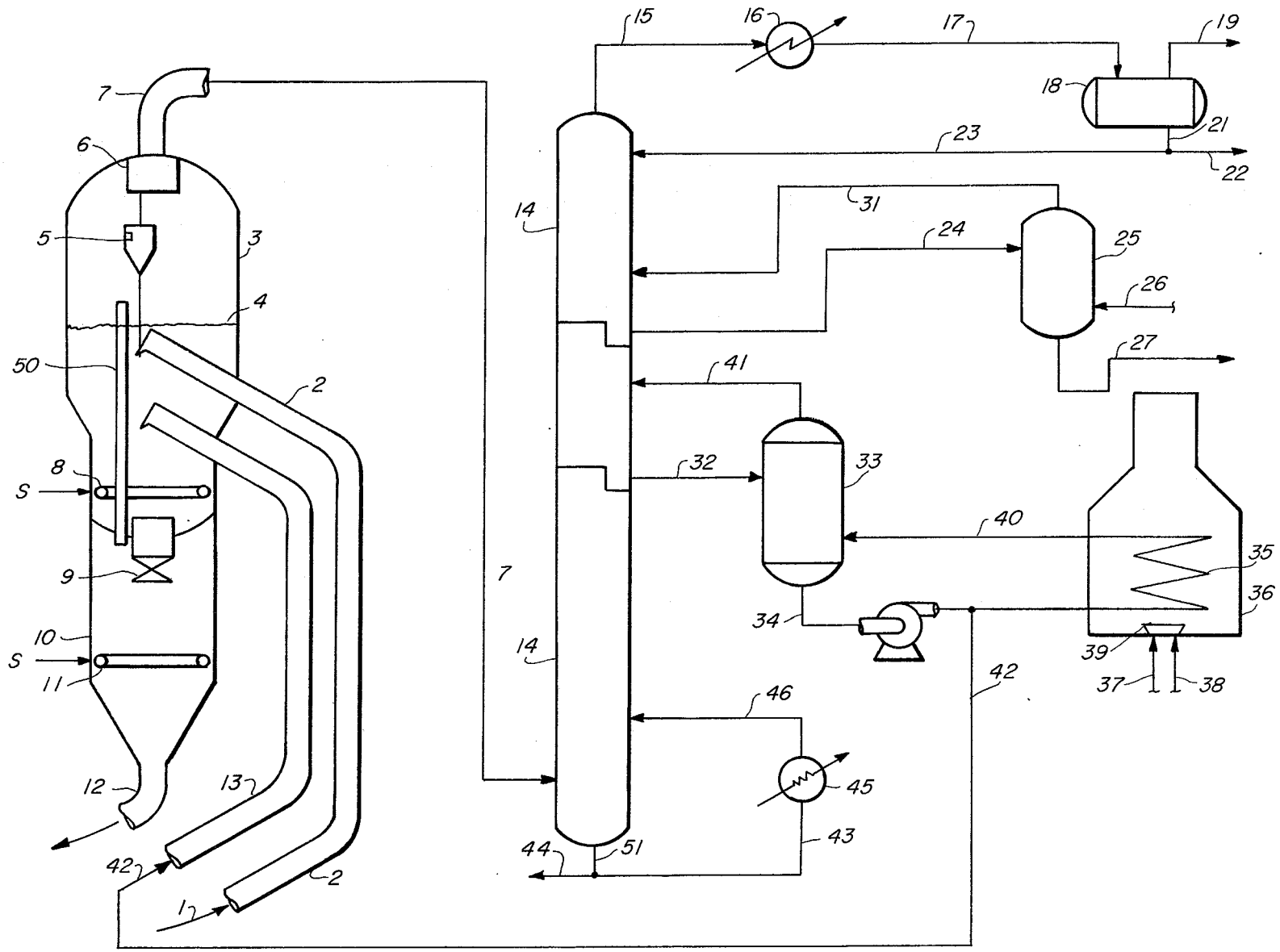
19
21
22
18
17
23
16
15
25
26
27
24
31
35
36
38
39
37
40
42
33
34
41
32
45
43
46
51
14
14
44
7
2
2
3
4
13
1
7
6
5
50
8
S
9
10
S
11
12
42

FLUIDIZED CATALYTIC CRACKING PROCESS WITH IMPROVED INTERMEDIATE CYCLE GAS OIL STRIPPING

BACKGROUND OF THE INVENTION

The present invention relates to a fluidized catalytic cracking process wherein fresh hydrocarbon charge is converted in a reaction zone, wherein cracked hydrocarbon vapors from the reaction zone are separated, in a fractionation zone, into desired fractions including an intermediate cycle gas oil fraction, and wherein at least a portion of the intermediate cycle gas-oil fraction is recycled to the fluidized catalytic cracking reaction zone for conversion into additional cracked hydrocarbon products. More particularly, the present invention relates to an improved process for obtaining an intermediate cycle gas oil fraction from a product fractionation zone, stripping light cycle gas oil components from said intermediate cycle gas oil fraction and recycling stripped intermediate cycle gas oil to the reaction zone at an elevated temperature such that preheat of said stripped intermediate cycle gas oil is not required.

In commercial processes for fluidized catalytic cracking of hydrocarbons, a fresh hydrocarbon charge stock is contacted with hot regenerated catalyst in a reaction zone for conversion of said charge stock into lower boiling cracked hydrocarbons and coke. Subsequently, spent catalyst, having coke deposited thereon, is separated from cracked hydrocarbon vapors and the spent catalyst is transferred from the reaction zone to a regeneration zone for burning coke and regenerating said catalyst. Cracked hydrocarbon vapors from the reaction zone are transferred into a product fractionation zone wherein the cracked hydrocarbon vapors are separated into desired product fractions. Commonly, the product fractions include a gas fraction, a naphtha fraction, a light cycle gas oil fraction, an intermediate gas oil fraction, and a heavy cycle gas oil fraction. The gas fraction comprises low molecular weight hydrocarbons and hydrogen. The naphtha fraction comprises hydrocarbons boiling in the range of about $C_5$ to 430° F which are useful in the manufacture of gasoline motor fuels. The light cycle gas oil fraction having a boiling range of about 400°–650° F is useful in the manufacture of fuel oils. The intermediate cycle gas oil is a distillate fraction boiling in the range of about 540°–750° F., and although this intermediate cycle gas oil fraction may be used for production of heavy fuel oil, it is common practice for a substantial portion to be recycled to the reaction zone for conversion into additional lower boiling hydrocarbons. The heavy cycle gas oil fraction comprises a non-distillate bottoms fraction from the fractionation zone.

For economical operation of a fluidized catalytic cracking unit within a petroleum refinery it is desirable to have the ability to adjust the ratio of the various product fractions, according to product demand. For example, in the Winter season the demand for fuel oil increases and it is desirable to include within the light cycle gas oil fraction the maximum amount of hydrocarbons boiling within the fuel oil range. In Summer, demand for gasoline increases and it is desirable to include within the naphtha fraction the maximum amount of gasoline boiling range hydrocarbons. For obtaining flexibility in product distribution, it is common practice to provide steam strippers for adjusting the initial boiling points of the light cycle gas oil fraction and the intermediate cycle gas oil fraction. Light cycle gas oil from the fractionation zone is charged to the light cycle gas oil stripper and stripping steam is passed therethrough in order to vaporize naphtha boiling range components from light cycle gas oil fraction. By adjusting the amount of stripping steam employed, more or less of the naphtha hydrocarbons may be vaporized and returned to the fractionation zone for recovery with the naphtha fraction. That is, by controlling the steam stripping of light cycle gas-oil, the ratio of naphtha to light cycle gas oil may be adjusted over a limited range.

Also, it is common practice to provide a steam stripper for the intermediate cycle gas oil fraction such that light cycle gas-oil boiling range components of this fraction may be vaporized and returned to the product fractionation zone for recovery with the light cycle gas-oil fraction. Thus, a portion of light cycle gas-oil boiling range hydrocarbons present in the intermediate cycle gas oil fraction may selectively be recovered as light cycle gas-oil product, or may be included with the intermediate cycle gas-oil for recycle to the reaction zone or use as heavy fuel oil.

One disadvantage of such steam stripping for the adjustment of the initial boiling points of the light cycle gas oil fraction and the intermediate cycle gas oil fraction is, substantial quantities of steam, in the range of about 1 to 10 pounds of steam per barrel of hydrocarbon, are required. This steam passes overhead from the product fractionation zone and is condensed, forming a foul water component containing such impurities such as hydrocarbon sulfide, cyanides, phenols, etc. which must be subjected to substantial treating prior to disposal. Additionally, the portion of the stripped intermediate gas oil fraction which is recycled to the reaction zone for conversion into additional lower boiling hydrocarbons is commonly preheated to a temperature in the range of about 600°–750° F. Such preheat reduces the amount of regenerated catalyst which must be contacted with the intermediate cycle gas-oil in order to achieve a selected degree of conversion, and reduces the proportion of the intermediate cycle gas oil converted to coke.

SUMMARY OF THE INVENTION

According to the method of the present invention, improvements are disclosed for a process of fluidized catalytic cracking of petroleum hydrocarbons into lower boiling cracked hydrocarbon products. In such process, a hydrocarbon charge stock is contacted with hot regenerated catalyst in a reaction zone for conversion into lower-boiling hydrocarbons. Cracked hydrocarbon vapors, recovered substantially free of entrained catalyst from the reaction zone are separated, in a product fractionation zone into various product fractions including a gas fraction, a naphtha fraction, a light-cycle gas oil fraction, an intermediate cycle gas oil fraction, and a heavy cycle gas oil non-distillate fraction. Said light cycle gas oil fraction is stripped, in a light cycle gas oil stripping zone, for separation of naphtha boiling range components therefrom and for production of stripped light cycle gas oil product stream boiling in the range of about 400°–650° F. which is useful in fuel oil products. Said intermediate cycle gas-oil fraction is stripped, in an intermediate cycle gas oil stripping zone, for removal of light cycle gas oil boiling range components therefrom and for production of a stripped intermediate cycle gas oil product boiling in the range of about 575°–750° F. At least a portion of stripped intermediate cycle gas oil is recycled to said reaction zone for conversion, in the presence of regenerated catalyst, into additional lower boiling cracked hydrocarbon products. Accordingly, the improvements of the present invention to such fluidized catalytic cracking process comprises:

a. stripping said intermediate cycle gas oil fraction in said intermediate cycle gas oil stripping zone with reboiled intermediate cycle gas oil vapors for production of an overhead vapor stream comprising light cycle gas oil boiling range hydrocarbons and a bottom stream comprising stripped intermediate cycle gas oil having a temperature in the range of 600°–750° F;

b. reboiling a portion of said stripped intermediate cycle gas oil, in a direct fired reboiler, for production of intermediate cycle gas oil stripping vapors employed in step (c);

c. recycling a second portion of said stripped intermediate cycle gas oil, at a temperature in the range of 700°–800° F, from said intermediate cycle gas oil stripping vessel to said reaction zone for conversion into additional cracked hydrocarbon products.

Advantages of the process improvements of the present invention over processes of the prior art include a substantial reduction in preheat for fresh hydrocarbon charge to said fluidized catalytic cracking section; elimination of stripping steam, which produces foul water, from the intermediate cycle gas-oil stripper; and elimination of a separate intermediate cycle gas oil recycle preheater from the fluidized catalytic cracking process. These and other advantages of the improved methods of the present invention are discussed in the detailed description which follows.

BRIEF DESCRIPTION OF THE DRAWING

The drawing is a schematic representation of a fluidized catalytic cracking process employing the process improvements of the present invention.

DETAILED DESCRIPTION OF THE DRAWING

The appended drawing is a schematic representation of a fluidized catalytic cracking process employing the process improvements of the present invention. In the drawing, auxiliary piping, pumps, instrumentation valves, etc. which are normally employed in such a process, but which are unnecessary for the understanding of the present invention, have been omitted. The fluidized catalytic cracking process in the drawing embodies the improvements of the present invention and is intended for purposes of demonstration only. It is not only intended that the process of the drawing serve as a limitation to the present invention, which is fully set out in the claims appended to this specification.

In the drawing, fresh feed gas oil charge stock in line 1, having a temperature of 675° is contacted in riser 2 with regenerated catalyst, having a temperature of 1150° F. at a catalyst oil ratio of about 1:1 to 10:1 for cracking of fresh feed charge. Cracked hydrocarbon vapors and spent catalyst exit the upper end of riser 2 into reaction vessel 3 at a temperature of about 920° F wherein said cracked hydrocarbon vapors disengaged spent cracking catalyst, forming a hydrocarbon vapor phase and a dense fluidized bed of spent cracking catalyst. Said dense fluidized catalyst bed has an upper surface 4, within said reaction vessel 3. Volatile hydrocarbons are stripped from said spent cracking catalyst and said dense phase catalyst bed is maintained in a fluidized condition by the flow of stripping vapors from stripping vapor ring 8. Said stripping vapors flow upwardly through said dense spent catalyst bed and disengage upper surface 4 for entry into the hydrocarbon vapor phase. Spent catalyst from the bottom of reaction vessel 3 passes through slide valve 9 into stripping section 10 wherein additional volatile hydrocarbons are stripped therefrom by the action of stripping vapors from stripping vapor ring 11. Stripping vapors and hydrocarbon vapor pass from the upper portion of stripping section 10 to the hydrocarbon vapor phase in reaction vessel 3 via stripper vent line 50. Stripped catalyst passes via line 12 to a regeneration section, not shown, wherein said catalyst is regenerated for contact with additional hydrocarbon charge.

In the drawing, cracked hydrocarbon vapors in the upper portion of said reaction vessel 3 pass through cyclone separator 5, for removal of entrained catalyst. From cyclone separator 5, the cracked vapors pass into plenum chamber 6. It is to be understood that said cyclone separator 5 may comprise a plurality of cyclone separators in parallel and series arrangement designed for substantially complete separation of catalyst from said hydrocarbon vapors. From plenum chamber 6, cracked hydrocarbon vapors pass via line 7 into the lower portion of product fractionation column 14 wherein said hydrocarbon vapors are fractionated into a plurality of fractions. From the top of product fractionator 15 a vapor fraction is withdrawn via line 15 for condensation in condenser 16. From condenser 16, condensate and noncondensed gas passed via line 17 into overhead receiver 18 wherein said condensate separates from said noncondensed gases. From overhead receiver 18 a wet gas fraction comprising $C_4$ and lighter components is withdrawn via line 19 for further treatment in a gas separation plant, now shown. Liquid condensate, comprising naphtha boiling in the range of $C_5$–430° F, is withdrawn from overhead receiver 18 via line 21. A portion of said condensate is yielded via line 22, as naphtha product from the fluidized catalytic cracking process. A second portion of said liquid condensate from line 21 passes via line 23 to the upper portion of said product fractionation column 14 as external reflux to maintain the end boiling point of said naptha product fraction in the range of about 400°–430° F.

In the drawing, a light cycle gas oil fraction containing naphtha boiling range hydrocarbons is withdrawn from said fractionation column 14 via line 24. Said light cycle gas oil fraction has an initial boiling point in the range of about 400°–430° F., and an end point of about 650° F. From line 24 the light cycle gas-oil fraction flows into the upper portion of light cycle gas oil stripper vessel 25 within which said light cycle gas oil fraction is contacted with stripping vapors from line 26, thereby stripping naphtha components from said light cycle gas oil fraction. From the bottom of said light cycle gas oil stripping vessel 25 a stripped light cycle gas oil stream having an initial boiling point in the range of about 400°–450° F is withdrawn via line 27. Stripped vapors comprising naphtha boiling range hydrocarbons pass, via line 31, from said light cycle gas oil stripper to said fractionation column 14.

In the drawing, at an intermediate point of said product fracionation column 14, lower than said light cycle gas oil fraction draw point, an intermediate cycle gas oil fraction having a boiling range of about 575°–750° F. is withdrawn via line 32. Said intermediate cycle gas oil boiling range components. From line 32 said intermediate cycle gas oil fraction passes into the upper portion of intermediate cycle gas oil stripping vessel 33 wherein light cycle gas oil components are stripped from said intermediate cycle gas oil fraction by contact with reboiled intermediate cycle gas oil vapors. From the bottom of said intermediate cycle gas oil stripping vessel 33, a stripped intermediate cycle gas oil stream is withdrawn via line 34 at a temperature in the range of about 600°–750° F. A portion of said stripped intermediate cycle gas oil stream passes from line 34 into coils 35 direct fired reboiler 36. In direct fired reboiler 36, air from line 37 and fuel from line 38 are combusted in burner 39 to provide heat for reboiling said intermediate cycle gas oil within said coils 35. Reboiled intermediate cycle gas oil, comprising vapor and liquid, passes at a temperature in the range of about 700°–800° F from coils 35 via line 40 to the lower portion of said intermediate gas oil stripping vessel 33 wherein said reboiled intermediate cycle gas oil vapors contact said intermediate cycle gas oil fraction for stripping light cycle gas oil components therefrom. From the top of said intermediate cycle gas oil stripping vessel 33, hydrocarbon vapors, comprising light cycle gas oil range components flow via line 41 to said product fractionation column 14. Reboiled intermediate cycle gas oil vapor is contacted with intermediate cycle gas oil fraction in a ratio of from about 1/10 to about 8/10 in stripping vessel 33.

In the drawing, from line 34, a portion of the stripped intermediate cycle gas oil stream is withdrawn into line 42 at a temperature in the range of about 600°–750° F. as an intermediate cycle gas oil recycle stream. From line 42 said intermediate cycle gas oil recycle passes into riser 13 wherein said intermediate cycle gas oil recycle is contacted with regenerated catalyst having a temperature of about 1150° F., at a catalyst to oil ratio of about 1/1 to 10/1 lb/lb for conversion into additional cracked hydrocarbon products. From riser 13 spent catalyst and cracked hydrocarbon vapors exit the top of riser 13 at a temperature of about 920° F. into said fluidized catalytic cracking reaction vessel 3 below the upper surface 4 of said fluidized dense phase catalyst bed. In fluidized catalytic cracking reaction vessel 3 cracked intermediate cycle gas oil vapors disengage the upper surface 4 of the spent catalyst bed and comingle with fresh feed cracked hydrocarbon vapor in the upper portion of reaction vessel.

In the drawing, from the bottom of said product fractionation column 14, a non-distillate heavy cycle gas oil stream is withdrawn via line 51 at a temperature of about 680° F. A portion of said heavy cycle gas oil passes from line 51 via line 43 into waste heat boiler 45 wherein said first portion of heavy cycle gas oil is cooled to a temperature of about 450° F. From waste heat boiler 45, the cooled heavy cycle gas oil flows via line 46 as additional external reflux to the lower portion of said product fraction column 14. A second portion of said heavy cycle gas oil withdrawn from line 51 flows via line 44 as product heavy cycle gas-oil.

In the process of the present invention fresh hydrocarbon charge stock and stripped intermediate cycle gas oil are contacted with hot, regenerated fluidized catalytic cracking catalyst under condition of temperature and pressure to effect substantial conversion of charge and recycle into hydrocarbons lower boiling than 430° F., and coke.

Hydrocarbon charge stocks which may be used in the process of the present invention include, atmospheric gas-oil, vacuum gas-oil, atmospheric gas-oil, vacuum gas oil, atmospheric residuum, shale oil, naphtha, and other petroleum and hydrocarbon fractions boiling in the range of about 430° F. to about 1100° F. The stripped intermediate cycle gas-oil comprises a fraction recovered in the fractionation zone 14 and has a boiling range of from about 575° F. to about 750° F.

Catalyst with which the hydrocarbon charge and intermediate cycle gas-oil may be contacted include fluidized catalytic cracking catalyst. Such catalysts may comprise silica-alumina, silica-magnesia, silica-zirconia, and particularly useful are catalysts comprising an amorphous silica-alumina matrix containing crystalline silica-alumina zeolite, wherein said zeolites are ion exchanged with rare earth, magnesium and/or hydrogen such that the sodium content is less than about one weight percent of said zeolite. Fluidized catalytic cracking catalysts are well known in the art.

Reaction temperatures within reaction vessel 3 may be in the range of from about 850° F. to about 1100° F., and pressures may be in the range of from about 10 psig to about 50 psig for effecting an overall conversion of fresh hydrocarbon charge and intermediate cycle gas oil of from about 50 to about 90% based upon fresh hydrocarbon charge. Preferably conversion, based upon fresh hydrocarbon charge, may range from about 30 to about 75%. Conversion of intermediate cycle gas-oil may range from about 10 to about 100%, based upon intermediate cycle gas-oil charge to reactor vessel 3.

The fractionation column 14, within contemplation of the present invention, is a charge-reboiled column operating at an overhead pressure of from about atmospheric to about 45 psig, wherein the cracked hydrocarbon vapor charge to the column, in line 7, is at a temperature of from about 800° F to about 1100° F. To obtain product fractions of desired boiling range from fractionation column 14, the overhead temperature is maintained at about 175° to about 350° F; the light cycle gas-oil draw temperature is in the range of about 400° to 550° F; the intermediate cycle gas oil draw temperature is in the range of about 575° F.

In stripping vessel 33, intermediate cycle gas-oil from fractionation column 14 at a temperature of about 575° F is contacted with reboiled intermediate cycle gas-oil for stripping light cycle gas oil boiling range (400°–650° F) hydrocarbons and for producing a stripped intermediate cycle gas oil having a temperature in the range of about 600°–750° F. The intermediate cycle gas oil fraction from fractionation column 14 contains from about 20 to about 95 volume percent light cycle gas oil boiling range hydrocarbons. The intermediate cycle gas-oil fraction enters the upper portion of stripping vessel 33 at a temperature of about 575° F and reboiled intermediate cycle gas oil at a tempeature of about 700° to 800° F enters the lower portion of stripping vessel 33. The reboiled intermediate cycle gas oil comprises about 10 to 50 weight percent vapor. To obtain a stripped intermediate cycle gas oil having temperatures of about 600° to 750° F from the lower portion of stripping vessel 33, reboiled intermediate cycle gas oil vapor is contacted with intermediate cycle gas-oil fraction in a ratio of from about 1/10 to about 8/10. By adjusting the temperature of the reboiled intermediate cycle gas oil and the ratio of reboiled intermediate cycle gas oil to intermediate cycle gas oil fraction in stripping vessel 25, the amount of light cycle gas oil boiling range hydrocarbons stripped from the intermediate cycle gas oil fraction may be controlled. By stripping more or less of the light cycle gas oil hydro-carbons from the intermediate cycle gas oil, the volume of light cycle gas oil product recovered from the fluidized catalytic cracking process may be directly controlled.

An additional advantage of the process of the present invention resides in the elevated temperature (600°–750° F) at which the stripped intermediate cycle gas-oil is available for recycle to the reaction zone. At such elevated temperatures the stripped intermediate cycle gas-oil may be recycle without addition of preheat. Thus, a separate preheater for the recycle is not required and the amount of preheat normally provided fresh charge to the reaction zone may be substantially reduced. The reduction in preheat of fresh charge and recycle which may be accomplished employing the process of the present invention is equivalent to the heat added to the stripped intermediate cycle gas oil to raise its temperature from the intermediate cycle gas oil fraction draw temperature (575° F) to the selected temperature in the range of 600°–750° F.

It will be obvious to those skilled in the art that many modifications may be made within the scope of the present invention without departing from the spirit hereof, and the invention includes all such modifications.

We claim:

1. In a fluidized catalytic cracking process wherein a fresh feed hydrocarbon is contacted with regenerated catalyst in a cracking zone under cracking conditions, wherein cracked hydrocarbons vapors are separated from spent catalyst in a reaction vessel forming a hydrocarbon vapor phase and a dense phase fluidized catalyst bed, wherein the spent catalyst from said fluidized bed is returned to a regeneration zone for regeneration and subsequent contact with additional hydrocarbon charge, wherein cracked hydrocarbon vapors removed overhead from said reaction vessel are charged to a product fractionation column for separation into fractions including a wet gas fraction, a naphtha fraction, a light cycle gas oil fraction, an intermediate cycle gas oil fraction, and a heavy cycle gas oil fraction, wherein said light cycle gas oil fraction is stripped in a first stripping zone for separation of naphtha boiling range components therefrom and for production of a light cycle product boiling in the range of about 400°–650° F. wherein said intermediate cycle fraction is stripped in a second stripping zone for separation of light cycle gas oil boiling range hydrocarbons and for production of a stripped intermediate gas oil stream boiling in the range of about 575°–750° F., wherein a portion of said stripped intermediate cycle gas oil stream is contacted with regenerated catalyst in a fluidized catalytic cracking zone under cracking conditions and wherein cracked intermediate cycle gas oil vapors are separated from spent catalyst in said reaction vessel, such that said cracked intermediate cycle gas oil vapors enters the hydrocarbon vapor phase and the spent catalyst enters the dense phase fluidized catalyst bed; the improvement which comprises:

a. charging said intermediate cycle gas oil fraction, containing light cycle gas oil boiling range hydrocarbons from said product fractionation column to the upper portion of said second stripping zone for contact with reboiled intermediate cycle gas oil vapors, b. reboiling, in a second direct fired reboiling zone, a first stripped intermediate cycle gas oil stream withdrawn from the bottom of said second stripping zone, at a temperature of about 700° to 800° F. and a pressure of about atmospheric to 45 psig;

c. charging said reboiled intermediate cycle gas oil to the lower portion of said second stripping zone for stripping light cycle gas oil boiling range components from said intermediate cycle gas oil fraction; and d. recycling a portion of stripped intermediate cycle gas oil from the bottom of said second stripping zone to said fluidized catalytic cracking zone at a temperature of from about 600° F. to about 750° F.

2. In a fluidized catalytic cracking process comprising a hydrocarbon reaction zone, wherein hydrocarbon charge and intermediate cycle gas oil are converted into lower boiling cracked hydrocarbons and coke in the presence of cracking catalyst, a catalyst regeneration zone wherein spent catalyst from said reaction zone is regenerated by burning coke therefrom, and a product fractionation zone wherein cracked hydrocarbon vapor from the reaction zone is fractionated into a plurality of fractions including a naphtha fraction boiling in the range of about $C_5$ to about 430° F., a light cycle gas oil fraction boiling in the range of about 400° F. to about 650° F., an intermediate cycle gas oil fraction boiling in the range of about 575° F. to about 750° F., and a heavy cycle gas oil non-distillate fraction; the improvement which comprises:

a. stripping, in a stripping vessel said intermediate cycle gas oil fraction with reboiled intermediate cycle gas oil from step (b) for production of a vapor fraction comprising light cycle gas oil boiling range hydrocarbons and stripped intermediate cycle gas oil having a temperature in the range of about 600° F. to about 750° F;

b. reboiling, in an intermediate cycle gas-oil reboiler, a first portion of said stripped intermediate cycle gas oil at a temperature in the range of about 700°–800° F; and c. contacting, in said hydrocarbon reaction zone, a second portion of said stripped intermediate cycle gas oil having a temperature in the range of 600°–750° F. with hot, regenerated catalyst from said catalyst regeneration zone, for conversion into additional cracked hydrocarbons.

3. The method of claim 2 wherein stripped intermediate cycle gas oil is reboiled in a direct fired reboiler.

4. The method of claim 3 wherein said reboiled intermediate cycle gas oil, at a temperature of from about 700° to 800° F. is contacted, in stripping vessel, with said intermediate cycle gas oil fraction in a liquid volume ratio of from about 1/10 to about 8/10, respectively, for production of a vapor phase comprising light cycle gas oil boiling range hydrocarbons and a stripped intermediate cycle gas oil having a temperature in the range of about 600°–750° F.

5. The method of claim 4 wherein said vapor phase comprising light cycle gas oil hydrocarbons is returned to said fractionation column.

* * * * *